United States Patent [19]

Torborg

[11] Patent Number: 4,588,372

[45] Date of Patent: May 13, 1986

[54] FLAME IONIZATION CONTROL OF A PARTIALLY PREMIXED GAS BURNER WITH REGULATED SECONDARY AIR

[75] Inventor: Ralph H. Torborg, Minnetonka, Minn.

[73] Assignee: Honeywell Inc., Minneapolis, Minn.

[21] Appl. No.: 421,926

[22] Filed: Sep. 23, 1982

[51] Int. Cl.[4] ..... F23N 5/12

[52] U.S. Cl. ..... 431/78; 431/12; 431/75; 431/90

[58] Field of Search ..... 431/12, 78, 25, 90, 431/75, 76, 66, 80; 126/110 C, 116 A

[56] References Cited

U.S. PATENT DOCUMENTS

| | | | |
|---|---|---|---|
| 2,324,821 | 7/1943 | Campbell | 431/12 X |
| 2,352,143 | 6/1944 | Wills | 431/12 |
| 2,940,255 | 6/1960 | MacCracken | 60/39.281 |
| 3,301,307 | 1/1967 | Nishigaki et al. | 431/15 |
| 3,964,859 | 6/1976 | Nishi et al. | 431/78 |
| 4,050,877 | 9/1977 | Craig et al. | 431/76 |
| 4,113,417 | 9/1978 | Dervelle . | |
| 4,340,355 | 7/1982 | Nelson et al. | 431/20 |
| 4,348,169 | 9/1982 | Swithenbank et al. | 431/12 |

FOREIGN PATENT DOCUMENTS

| | | | |
|---|---|---|---|
| 132831 | 4/1978 | Japan | 431/78 |
| 126731 | 9/1980 | Japan | 431/75 |
| 157725 | 12/1981 | Japan | 431/78 |
| 2075718 | 11/1981 | United Kingdom | 431/12 |

OTHER PUBLICATIONS

Honeywell Brochure 95-6957-1, FSP 1400 Fuel-Air Ratio Sensor, Rev. 10-70.

*Primary Examiner*—Margaret A. Focarino
*Assistant Examiner*—Carl D. Price
*Attorney, Agent, or Firm*—Clyde C. Blinn

[57] ABSTRACT

A gas burning furnace has a burner in which the premixed fuel/air ratio of the burned gas in the burner flame is measured by a flame rod sensing the ionization current. The flame rod is connected to a fuel/air controller which controls the gas and primary air to the burner to maintain the maximum flame ionization current which results in an excessive amount of gas to the burner. The secondary air to the combustion chamber is proportionally controlled to add sufficient oxidant to the gas combustion in the combustion chamber to ensure complete combustion. Other properties of the flame or combustion products can also be used.

4 Claims, 2 Drawing Figures

FLAME IONIZATION CONTROL OF A PARTIALLY PREMIXED GAS BURNER WITH REGULATED SECONDARY AIR

BACKGROUND AND SUMMARY OF THE INVENTION

For many years the control of fuel/air ratio of fuel burners for various furnaces or heating appliances has been desired. One particular method is to automatically search for the peak value (maximum or minimum) of a property of the flame or combustion products which is indicative of the fuel/air or oxidant ratio of the fuel being burned in the burner and by various means adjusting the fuel/oxidant ratio in the combustion chamber for complete combustion.

Several years ago Honeywell Inc. developed an FSP1400 Fuel-Air Ratio Sensor described in a Honeywell publication 95-6957-1 of October 1970 which made use of a flame rod for sensing the ionization current in a small flame having the same premixed fuel/air ratio as the main burner. By means of a control apparatus the fuel/oxidant ratio of the burner was adjusted to provide maximum ionization current. The maximum current always occurred at a premixed fuel/oxidant ratio 15% greater than the stoichiometric ratio. Reducing the fuel/oxidant ratio until the current was 80% of maximum gave stoichiometric combustion.

The present invention is concerned with a gas burning furnace in which the control system searches for and maintains the ionization current at a peak value by controlling the fuel and primary air supply to the burner. This results in an excessive amount of fuel. The secondary air supply to the combustion chamber is controlled proportionally to the primary air supply in such a manner that the fuel/oxidant ratio in the combustion chamber is adequate for complete combustion. Secondary air has little or no effect on ionization current. Other properties of flames or combustion products which have peak values at or near the stoichiometric ratio could also be used to monitor fuel/oxidant ratio. These include flame temperature, flame radiation, $H_2O$ and/or $CO_2$ levels in the burned gases, etc. Properties of flames or combustion products which have minimum values at or near the stoichiometric ratio could also be used.

DESCRIPTION OF THE PREFERRED EMBODIMENT

Figure 1:
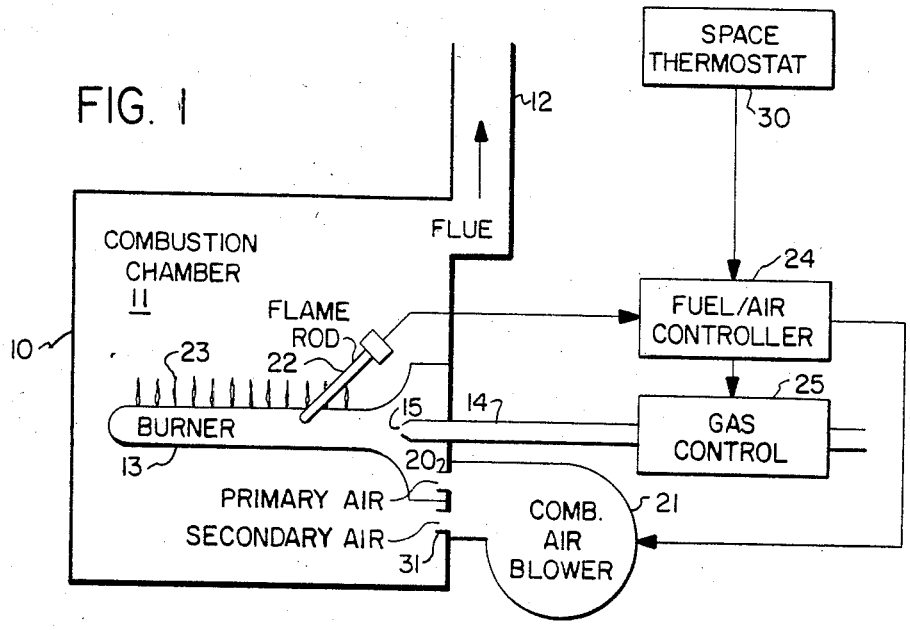
FIG. 1 is a schematic showing of a conventional furnace or combustion appliance having a burner in the combustion chamber to which gas or fuel and primary air is supplied. The combustion chamber is then supplied with secondary air for maximum combustion efficiency.

Referring to FIG. 1, a furnace or fuel burning heating appliance 10 is shown to have a combustion chamber 11 which is connected to an exhaust flue or stack 12 through which the products of combustion pass to the outside. A burner 13 mounted in the combustion chamber is supplied with fuel or gas through pipe 14 having a burner orifice 15. Primary air to burner 13 is supplied through primary air orifice 20 by a forced draft or a combustion air blower 21. While the combustion air is supplied under pressure by blower 21, with the advent of induced draft furnaces, the combustion air through primary orifice 20 might be induced by a blower in exhaust flue 12 as disclosed in the Lorne W. Nelson, et al, U.S. Pat. No. 4,340,355, issued July 20, 1982. A flame rod 22 is mounted in burner flame 23 and is connected to a conventional fuel/air controller or control system 24 for controlling the output of a gas control or valve 25 and the output of the blower or primary air supply to the burner to maintain a peak flame rod current. Fuel-/air controller 24 uses the principle developed by Honeywell some years back as the FSP1400 Fuel-Air Ratio Sensor. The maximum flame ionization current always occurs at a fixed premixed fuel/air ratio, i.e., 15% excess fuel. Fuel/air ratio can then be controlled by maximizing the electrical current of the flame rod 22. A conventional space thermostat 30 is connected to the controller 24 for bringing about operation of the furnace when there is a need for heat in the space to which heat is supplied by furnace 10.

Figure 2:
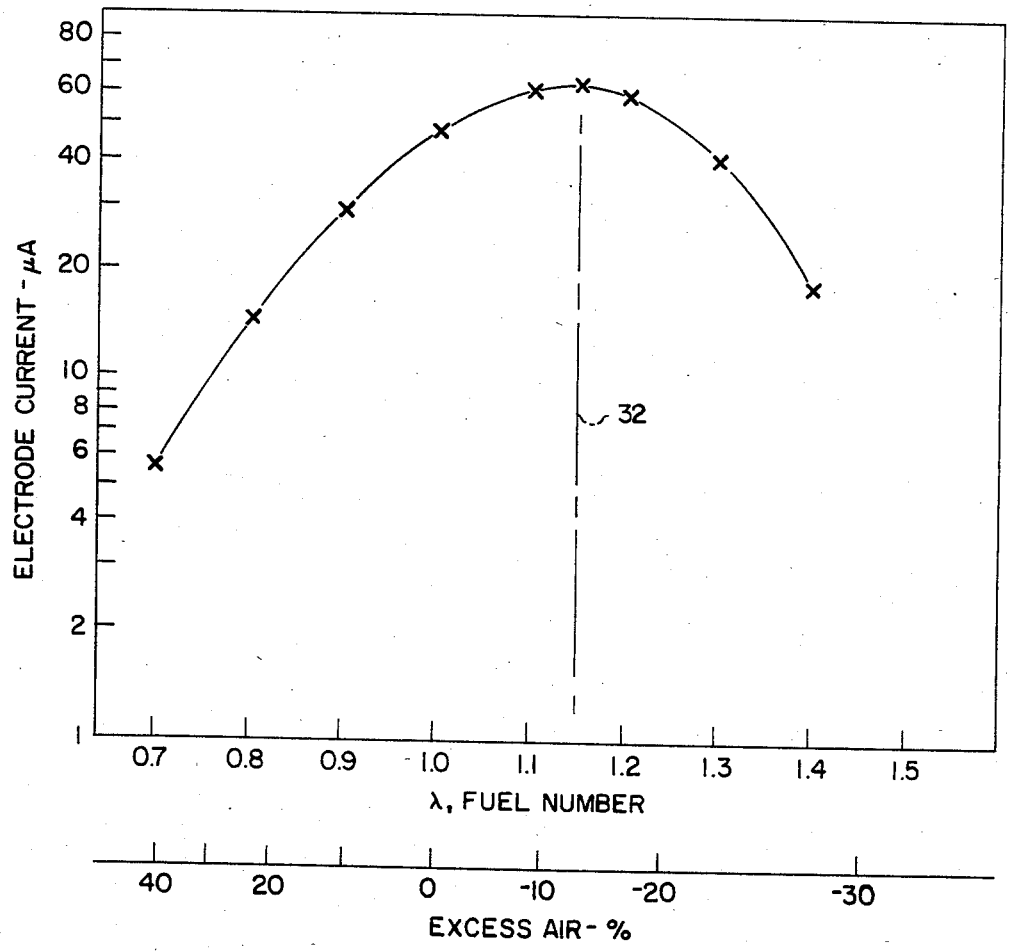
FIG. 2 is a graphical representation showing the flame rod electrode current for various levels of premixed fuel/oxidant ratio (fuel number or excess air percentage).

Referring to FIG. 2, when the premixed fuel/oxidant ratio produces a maximum current as shown at 32, the fuel number is in excess of 1.0 and there is an excess of fuel. Such is maintained at the burner by the control of the gas control 25 and the primary air through orifice 20. This maintains undesired combustion performance because the combustible gases of the fuel are burned with insufficient air and incomplete combustion takes place. As the primary air through orifice 20 and the secondary air through orifice 31 are proportionally controlled regardless of the speed of blower 21, by maximizing the ionization current of the flame rod by controller 24, complete combustion in the combustion chamber takes place for maximum efficiency of the furnace. Other characteristic values of properties of the flame or combustion products might be used by the controller 24 such as the characteristic slope of a property shown in FIG. 2.

The embodiments of the invention in which an exclusive property or right is claimed are defined as follows:

1. A gas burning furnace comprising a gas burner mounted in a combustion chamber, said combustion chamber having an exhaust outlet adapted to be connected to a flue, a gas inlet to said burner connected to a gas control adapted to receive gas from a gas source, a primary air inlet of said burner connected to an air supply means supplying primary air to said burner to mix with said gas received by the burner to provide a premixed gas go air ratio for burning of said gas, ignition means for igniting said premixed gas and air mixture, control means responsive to an ionization current of the burner flame, said ionization current produced by a sensor means, wherein said sensor means has a characteristic maximum value for said ionization current at a premixed gas and air mixture of said burner where incomplete combustion due to a shortage of primary air exists, said control means being connected to said gas control to control said gas and said ratio of gas to primary air supply to maintain said ionization current at said maximum value, and a secondary air inlet to said combustion chamber connected to said air supply means, said secondary air inlet being sized with respect to said primary air inlet to proportionally maintain an excess air in said combustion chamber for complete combustion of said gas in said combustion chamber.

2. The invention of claim 1 wherein said air supply means connected to said primary and secondary air inlets is a blower means, and said control means is connected to said blower means to maintain the volume of said primary air for said maximum value of said flame and the volume said secondary air so as to provide an excess of air for complete combustion in said combustion chamber.

3. The invention of claim 1 wherein said sensor means is a flame rod in the flame of said burner and said control means is responsive to said ionization current of said gas flame for controlling said ratio of gas and primary air for maintaining a predetermined gas and air ratio.

4. The invention of claim 3 wherein said ionization current of said flame rod is at said characteristic maximum value an excess of gas is supplied to said burner and incomplete combustion of said primary air and gas mixture occurs, and said air supply means connected to said secondary air inlet supplies the additional secondary air to have complete combustion of said primary air and gas mixture in said combustion chamber.

* * * * *

UNITED STATES PATENT AND TRADEMARK OFFICE

CERTIFICATE OF CORRECTION

PATENT NO. : 4,588,372

DATED : May 13, 1986

INVENTOR(S) : RALPH H. TORBORG

It is certified that error appears in the above-identified patent and that said Letters Patent is hereby corrected as shown below:

Column 2, line 53, delete "go" and insert --to--.

Column 4, line 8, after "value" insert --when--.

Signed and Sealed this

*Twenty-sixth* Day of *August 1986*

[SEAL]

*Attest:*

DONALD J. QUIGG

*Attesting Officer*

*Commissioner of Patents and Trademarks*